US010819042B2

(12) United States Patent
Xia et al.

(10) Patent No.: US 10,819,042 B2
(45) Date of Patent: Oct. 27, 2020

(54) BROADBAND LOW-PROFILE DUAL-LINEARLY POLARIZED ANTENNA FOR A ONELTE TWO-IN-ONE PLATFORM

(71) Applicant: PC-TEL, Inc., Bloomingdale, IL (US)

(72) Inventors: Xiao Hong Xia, Beijing (CN); Ma Chang Ming, Beijing (CN)

(73) Assignee: PC-TEL, INC., Bloomingdale, IL (US)

( * ) Notice: Subject to any disclaimer, the term of this patent is extended or adjusted under 35 U.S.C. 154(b) by 0 days.

(21) Appl. No.: 16/123,938

(22) Filed: Sep. 6, 2018

(65) Prior Publication Data

US 2019/0081413 A1 Mar. 14, 2019

(30) Foreign Application Priority Data

Sep. 8, 2017 (CN) ..... 2017 1 0804959

(51) Int. Cl.
*H01Q 21/24* (2006.01)
*H01Q 9/04* (2006.01)
(Continued)

(52) U.S. Cl.
CPC ..... *H01Q 21/245* (2013.01); *H01Q 1/246* (2013.01); *H01Q 5/357* (2015.01); *H01Q 5/385* (2015.01);
(Continued)

(58) Field of Classification Search
CPC ..... H01Q 21/245; H01Q 9/0414; H01Q 5/48; H01Q 5/357; H01Q 1/38; H01Q 5/364;
(Continued)

(56) References Cited

U.S. PATENT DOCUMENTS 8,228,254 B2 * 7/2012 Foltz ..... H01Q 1/38 343/795
10,038,240 B2 * 7/2018 Patron ..... H01Q 3/24
(Continued)

FOREIGN PATENT DOCUMENTS

CN 202 004 160 U 10/2011
CN 102 104 203 B 6/2014
(Continued)

OTHER PUBLICATIONS

English-language translation of CN publication 105896071, dated Aug. 24, 2016.
(Continued)

*Primary Examiner* — Trinh V Dinh
(74) *Attorney, Agent, or Firm* — Husch Blackwell LLP

(57) ABSTRACT

A broadband low-profile dual-linearly polarized antenna for a OneLTE two-in-one platform and an antenna array device formed therefrom are provided that can realize low-profile and ultra-broadband and have such advantages as simple structure, neat appearance, easy engineering implementation, and suitability for mass production. The broadband low-profile dual-linearly polarized antenna can include (1) a radiating portion that can include a dielectric substrate, printed folded dipoles spaced apart on an upper surface of the dielectric substrate, first coupled parasitic elements on a lower surface of the dielectric substrate, and second coupled parasitic elements on the upper surface of the dielectric substrate and (2) a feed balun for feeding the radiating portion, wherein each of the printed folded dipoles can include a corresponding one of the first coupled parasitic elements and a corresponding one of the second coupled parasitic elements.

13 Claims, 10 Drawing Sheets

(51) Int. Cl.

| | |
|---|---|
| ***H01Q 5/357*** | (2015.01) |
| ***H01Q 5/48*** | (2015.01) |
| ***H01Q 21/26*** | (2006.01) |
| ***H01Q 1/24*** | (2006.01) |
| ***H01Q 19/10*** | (2006.01) |
| ***H01Q 9/26*** | (2006.01) |
| ***H01Q 5/385*** | (2015.01) |
| *H01Q 1/38* | (2006.01) |
| *H01Q 9/28* | (2006.01) |
| *H01Q 21/08* | (2006.01) |
| *H01Q 5/364* | (2015.01) |

(52) U.S. Cl.
CPC ..... *H01Q 5/48* (2015.01); *H01Q 9/0414* (2013.01); *H01Q 9/26* (2013.01); *H01Q 19/108* (2013.01); *H01Q 21/26* (2013.01); *H01Q 1/38* (2013.01); *H01Q 5/364* (2015.01); *H01Q 9/28* (2013.01); *H01Q 21/08* (2013.01)

(58) Field of Classification Search
CPC ..... H01Q 21/08; H01Q 9/28; H01Q 5/385; H01Q 21/26; H01Q 19/108; H01Q 9/26; H01Q 1/246; H01Q 21/0006; H01Q 19/10; H01Q 15/24; H01Q 1/50
See application file for complete search history.

(56) References Cited

U.S. PATENT DOCUMENTS

| | | | | |
|---|---|---|---|---|
| 2011/0043424 | A1 | 2/2011 | Lee et al. | |
| 2014/0139387 | A1* | 5/2014 | Jones | H01Q 19/30 343/794 |
| 2016/0134026 | A1* | 5/2016 | Tang | H01Q 15/14 343/797 |
| 2017/0250462 | A1* | 8/2017 | Li | H01Q 21/26 |
| 2018/0034165 | A1* | 2/2018 | Aleksandrovich | H01Q 21/26 |
| 2018/0040956 | A1* | 2/2018 | Lee | H01Q 19/10 |
| 2020/0067205 | A1* | 2/2020 | Segador Alvarez | H01Q 21/0006 |

FOREIGN PATENT DOCUMENTS

| | | | |
|---|---|---|---|
| CN | 105896071 | A | 8/2016 |
| WO | 2016/133244 | A1 | 8/2016 |
| WO | 2017/003374 | A1 | 1/2017 |

OTHER PUBLICATIONS

Biao Li et al., Wideband Dual-Polarized Patch Antenna With Low Cross Polarization and High Isolation, IEEE Antennas and Wireless Propagation Letters, vol. 11, pp. 427 thru 430, dated 2012.

Shi-Gang Zhou et al., Low-Profile, Wideband Dual-Polarized Antenna With High Isolation and Low Cross Polarization, IEEE Antennas and Wireless Propagation Letters, vol. 11, pp. 1032 thru 1035, dated 2012.

Extended European search report from corresponding EP patent application 18193154.4, dated Jan. 31, 2019.

English-language translation of Abstract for CN patent publication 102104203, dated Jun. 11, 2014.

English-language translation of Abstract for CN patent publication 202004160, dated Oct. 5, 2011.

* cited by examiner

FIG. 5(a)
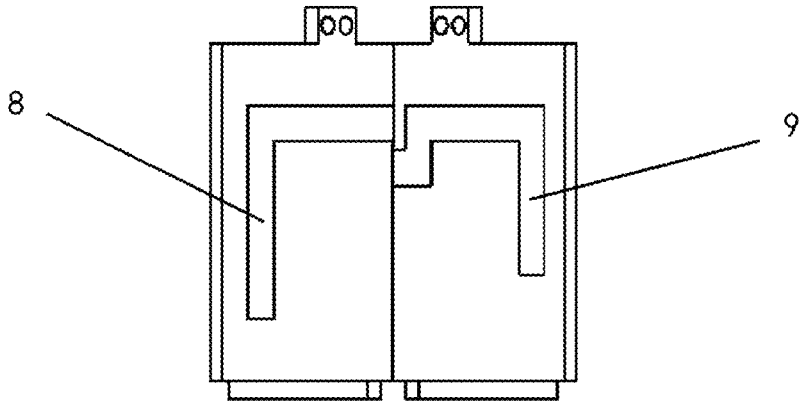
(a)
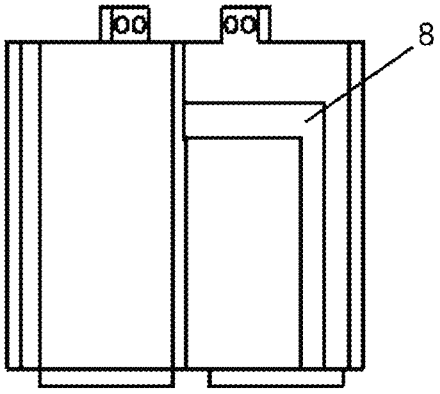
(b)
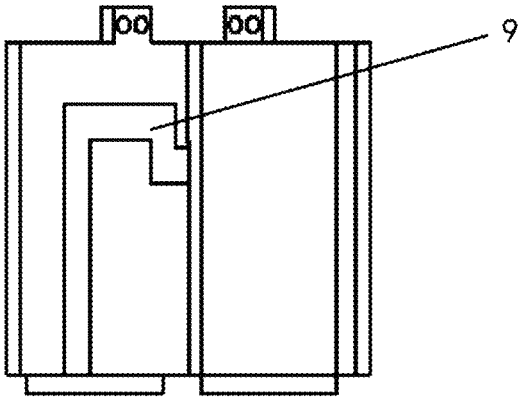
(c)
FIG. 5(b)
FIG. 5(c)

FIG. 9(a)
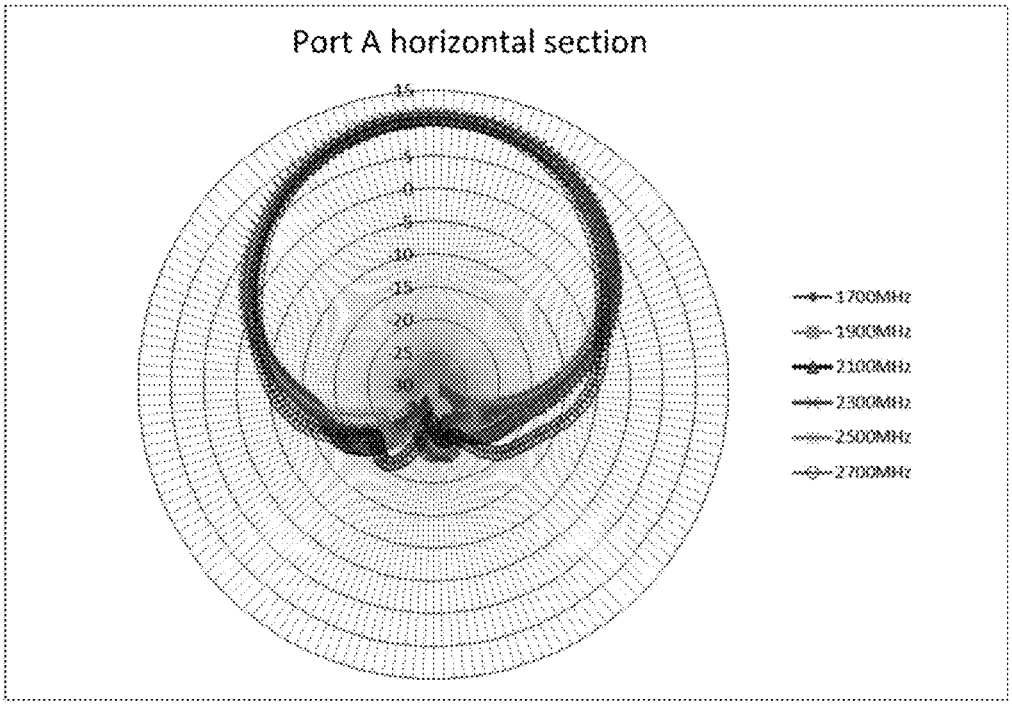
(a)
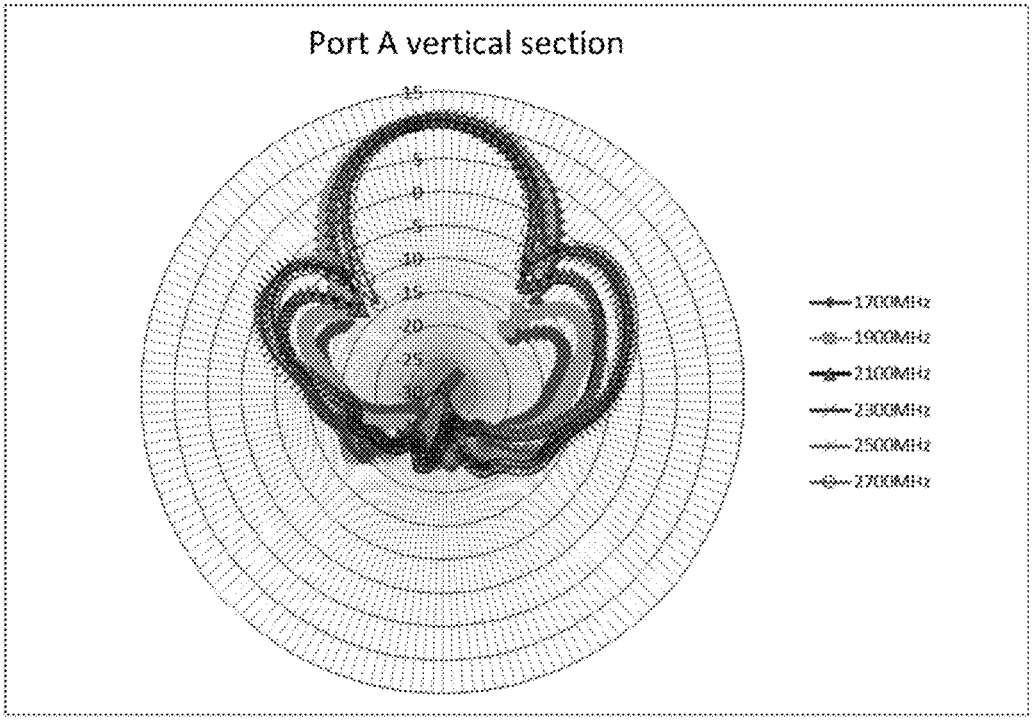
(b)
FIG. 9(b)

FIG. 9(c)
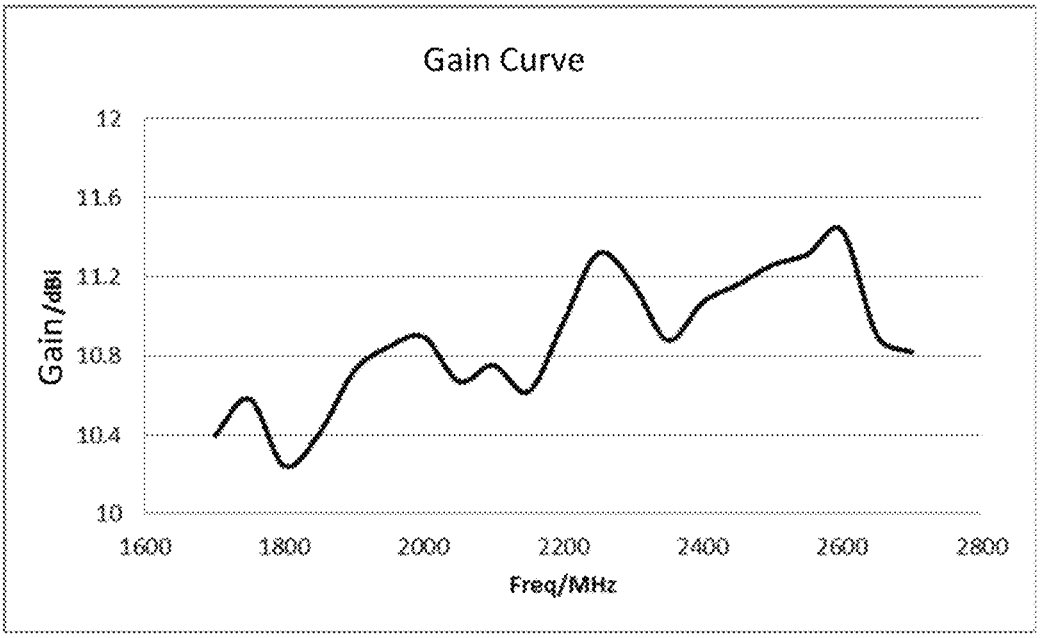
(c)
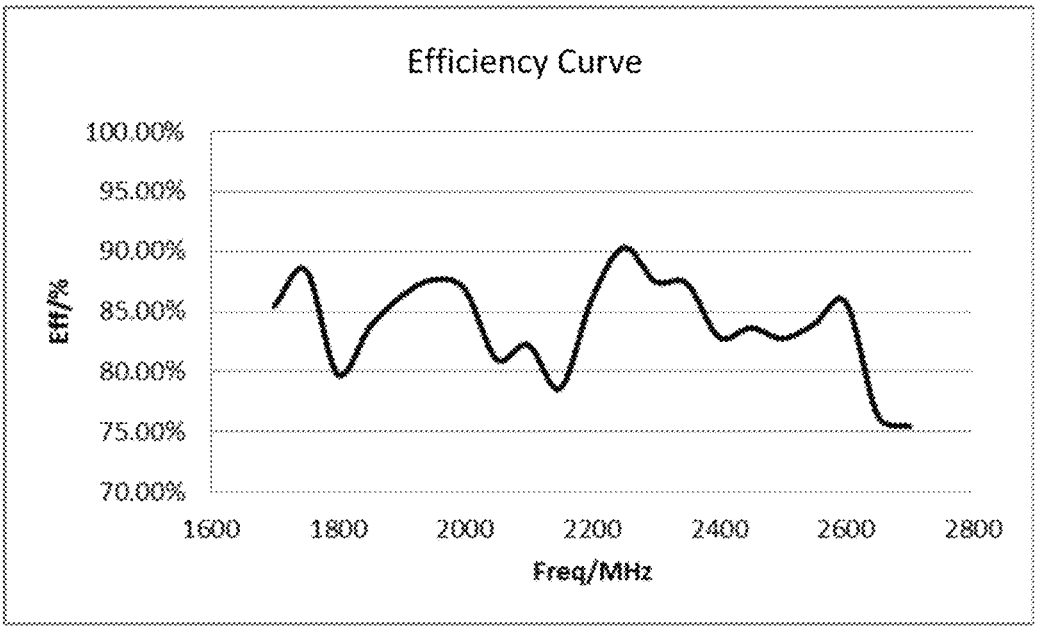
(d)
FIG. 9(d)

FIG. 10(a)
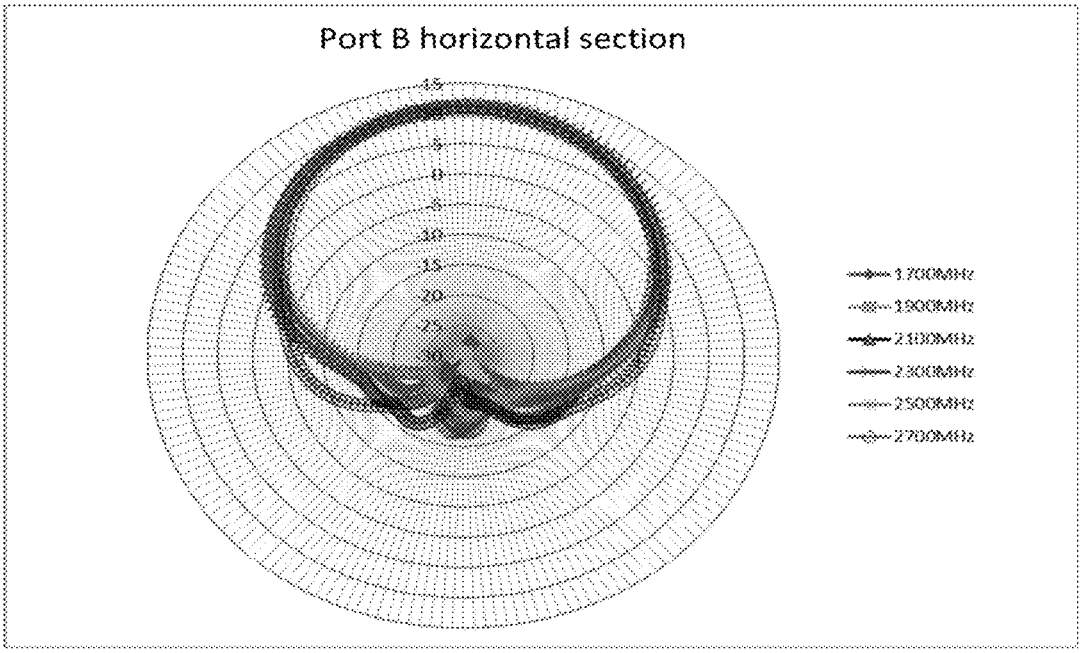
(a)
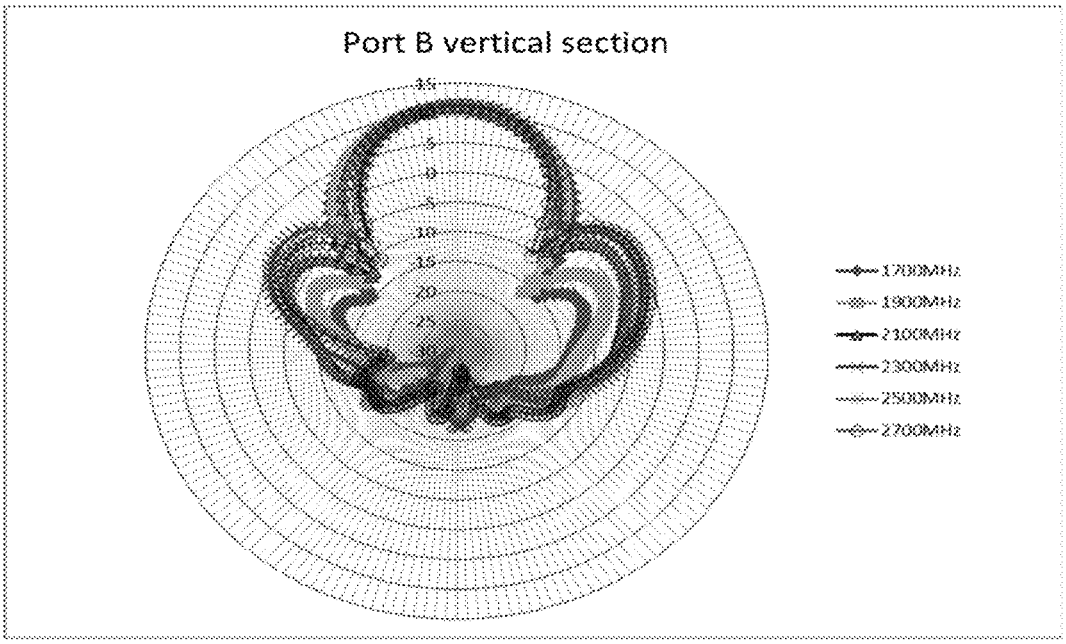
(b)
FIG. 10(b)

FIG. 10(c)
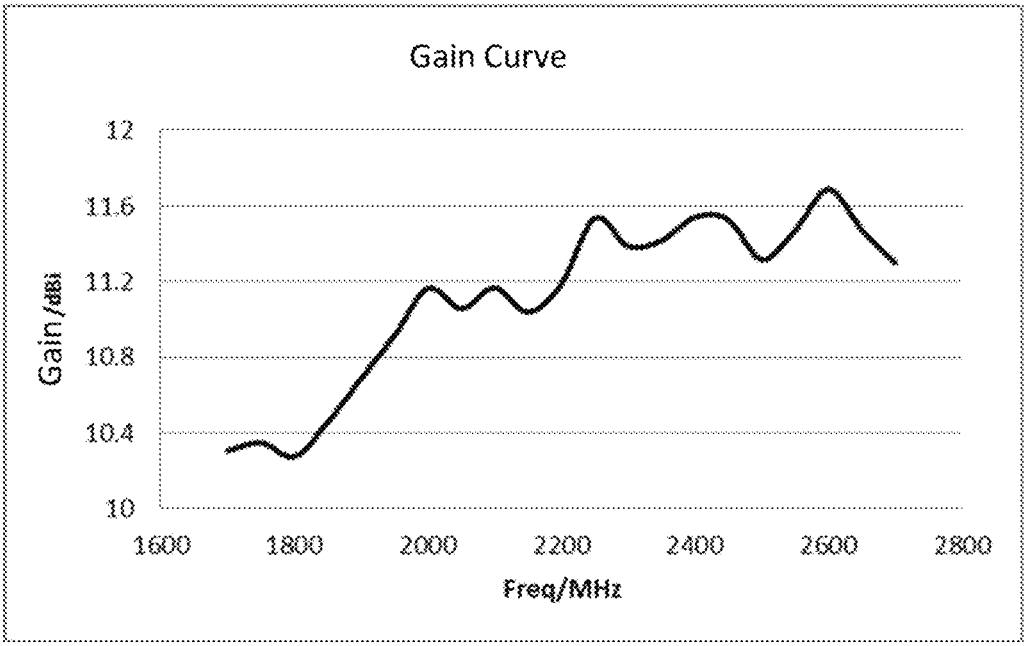
(c)
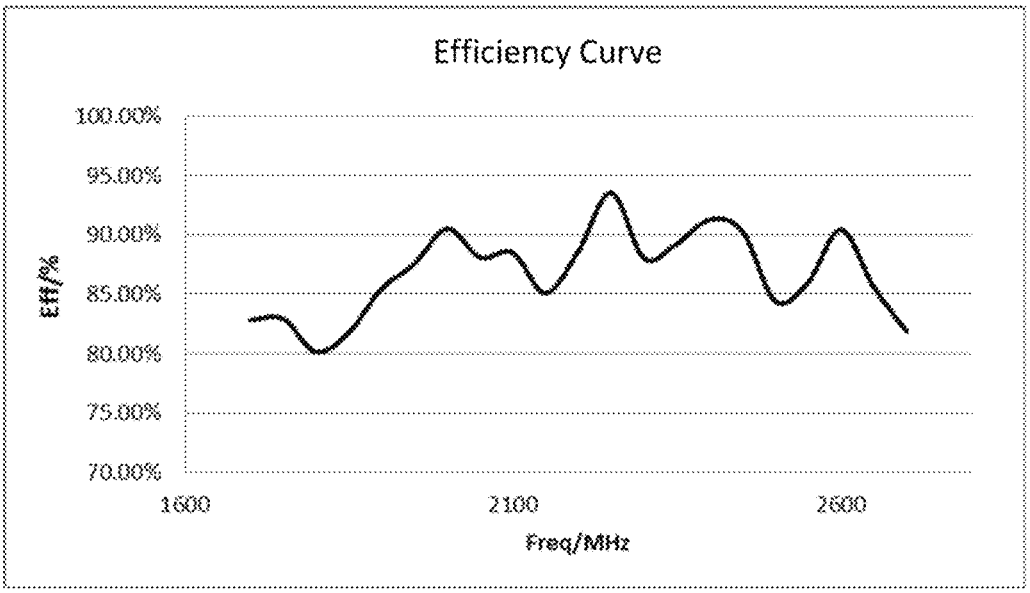
(d)
FIG. 10(d)

FIG. 11(a)
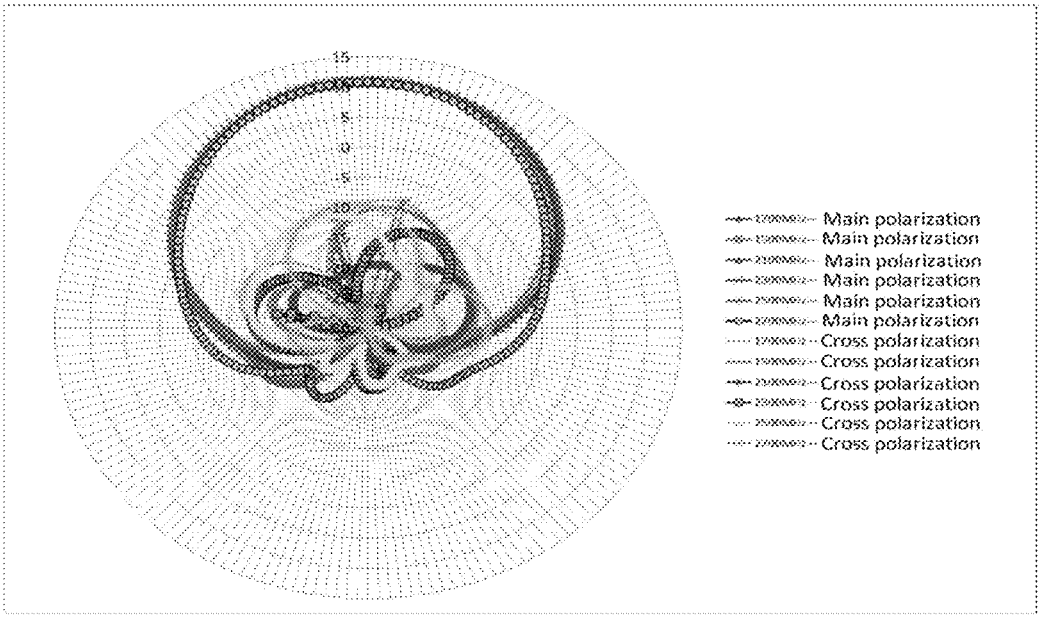
(a)
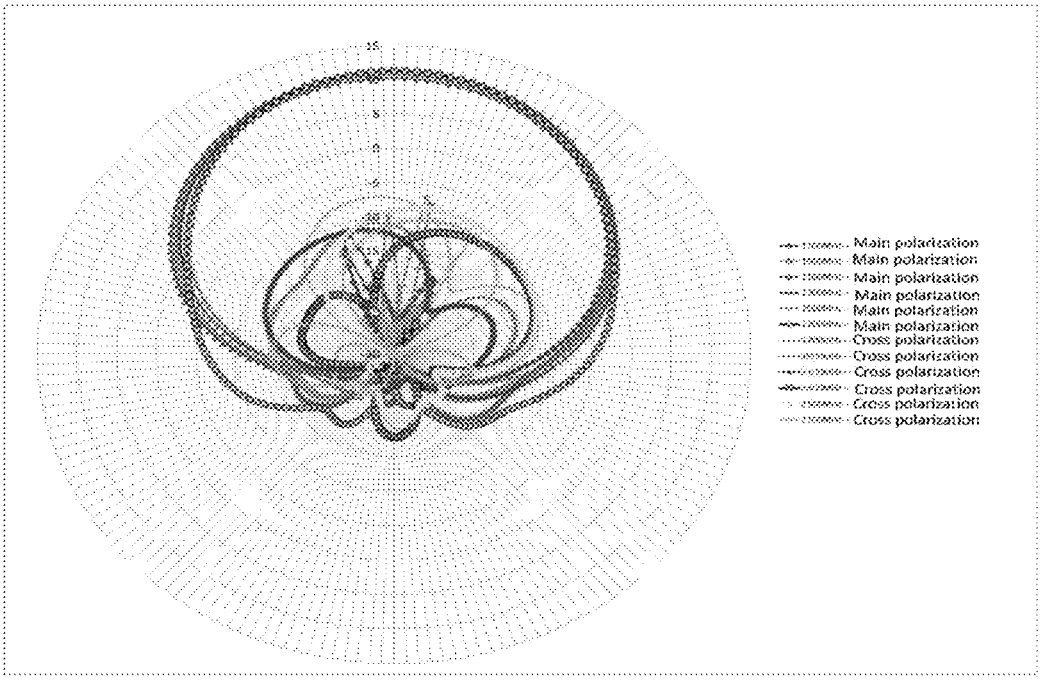
(b)
FIG. 11(b)

BROADBAND LOW-PROFILE DUAL-LINEARLY POLARIZED ANTENNA FOR A ONELTE TWO-IN-ONE PLATFORM

CROSS-REFERENCE TO RELATED APPLICATIONS

This application claims priority to Chinese Patent Application No. 201710804959.4 filed Sep. 8, 2017 and tilted "A Broadband Low-Profile Dual-Linearly Polarized Antenna for OneLTE Two-In-One Platform." Chinese Patent Application No. 201710804959.4 is hereby incorporated by reference.

FIELD

The present application generally relates to a broadband low-profile dual-linearly polarized antenna and, more specifically, to a broadband low-profile dual-linearly polarized antenna for a OneLTE two-in-one platform.

BACKGROUND

Currently, OneLTE technology is rapidly emerging. OneLTE refers to simultaneously comprising both TD-LTE and LTE FDD wireless network access modes and a shared core network in an LTE network. The two wireless network access modes complement each other and cooperate with each other to achieve site-level convergence, network interoperability, and performance level integration on a network side, thereby maximizing overall network capacity and coverage. Operators can, thus, use all of their own spectrum, including TDD and FDD, to provide a unified 4G network experience.

However, existing dual-linearly polarized antennas for OneLTE typically include two radiating portions (i.e., 1.8 GHz for FDD and 2.6 GHz for TDD) because neither has sufficient bandwidth. For example, the dual-linearly polarized antenna disclosed by the U.S. Pat. No. 3,740,754, the first of its kind to describe a dual-linearly polarized antenna, just cannot meet the needs of a wide frequency band. Therefore, such antennas for OneLTE are bulky and do not meet requirements for miniaturization. Furthermore, in these antennas, there is a fairly obvious mutual coupling between the high and low frequency radiating portions, causing distortion of the radiation pattern of the radiating portions of the different frequency bands.

Although some two-in-one broadband antennas satisfying the 1.8 GHz and 2.6 GHz frequency bands of OneLTE have appeared in academic papers or industrial products, the thickness of these antennas is usually about 35 mm, which cannot meet the requirements for smaller, lighter, broader, and greener antennas in the industrial design process of OneLTE base stations.

Therefore, in order to overcome the defects and deficiencies in the prior art, the disclosed invention provides a broadband low-profile dual-linearly polarized antenna that satisfies miniaturization for a OneLTE two-in-one platform.

SUMMARY

In order to solve the above-identified problems, the disclosed invention adopts the following technical solutions.

According to some embodiments, a broadband low-profile dual-linearly polarized antenna is provided that can include (1) a radiating portion that can include a dielectric substrate, printed folded dipoles spaced apart on an upper surface of the dielectric substrate, first coupled parasitic elements on a lower surface of the dielectric substrate, and second coupled parasitic elements on the upper surface of the dielectric substrate and (2) a feed balun for feeding the radiating portion, wherein each of the printed folded dipoles can include a corresponding one of the first coupled parasitic elements and a corresponding one of the second coupled parasitic elements.

Furthermore, according to some embodiments, a broadband low-profile dual-linearly polarized antenna array device is provided that can include (1) a plurality of the above-described dual-linearly polarized antennas, (2) a feed network that can include a power divider for feeding the plurality of dual-linearly polarized antennas in equal amplitude and in same phase, wherein the feed network can include two feed ports for respectively exciting a ±45° polarization mode to feed each of the plurality of dual-linearly polarized antennas through the power divider, and (3) a bottom metal reflector.

BRIEF DESCRIPTION OF THE DRAWINGS

FIG. 5(*a*) is a side view of first and second baluns of a feed balun of a broadband low-profile dual-linearly polarized antenna in accordance with disclosed embodiments with portions thereof obscured;

FIG. 5(*b*) is a side view of the first and second baluns of the feed balun of the broadband low-profile dual-linearly polarized antenna that shows the portions obscured in FIG. 5(*a*);

FIG. 5(*c*) is a side view of first and second baluns of a feed balun of the broadband low-profile dual-linearly polarized antenna that shows the portions obscured in FIG. 5(*a*);

FIG. 7(*b*) is a graph of a standing wave ratio curve of port B of the broadband low-profile antenna array device shown in FIG. 6;

FIG. 9(*a*) is a graph of antenna performance for port A of the broadband low-profile antenna array device shown in FIG. 6 and illustrates the horizontal section radiation pattern;

FIG. 9(*b*) is a graph of antenna performance for port A of the broadband low-profile antenna array device shown in FIG. 6 and illustrates the vertical section radiation pattern;

FIG. 9(*c*) is a graph of antenna performance for port A of the broadband low-profile antenna array device shown in FIG. 6 and illustrates the gain curve;

FIG. 9(*d*) is a graph of antenna performance for port A of the broadband low-profile antenna array device shown in FIG. 6 and illustrates the efficiency curve;

FIG. 10(*a*) is a graph of antenna performance for port B of the broadband low-profile antenna array device shown in FIG. 6 and illustrates the horizontal section radiation pattern;

FIG. 10(*b*) is a graph of antenna performance for port B of the broadband low-profile antenna array device shown in FIG. 6 and illustrates the vertical section radiation pattern;

FIG. 10(*c*) is a graph of antenna performance for port B of the broadband low-profile antenna array device shown in FIG. 6 and illustrates the gain curve;

FIG. 10(*d*) is a graph of antenna performance for port B of the broadband low-profile antenna array device shown in FIG. 6 and illustrates the efficiency curve;

FIG. 11(*a*) is a graph of the horizontal section radiation patterns of main polarization and cross polarization for port A of the broadband low-profile antenna array device shown in FIG. 6; and FIG. 11(*b*) is a graph of the horizontal section radiation patterns of main polarization and cross polarization for port B of the broadband low-profile antenna array device shown in FIG. 6.

DETAILED DESCRIPTION

The specific embodiments of the disclosed invention will be described in detail below with reference to the accompanying drawings in order to make the above objectives, features, and advantages of the disclosed invention clearer and more comprehensible.

In the following description, numerous specific details are set forth in order to provide a thorough understanding of the disclosed invention. However, the disclosed invention can be implemented in many other ways than those described herein, and a person skilled in the art can make a similar promotion without departing from the spirit of the disclosed invention. Therefore, the disclosed invention is not limited by the specific embodiments disclosed below.

Figure 1:
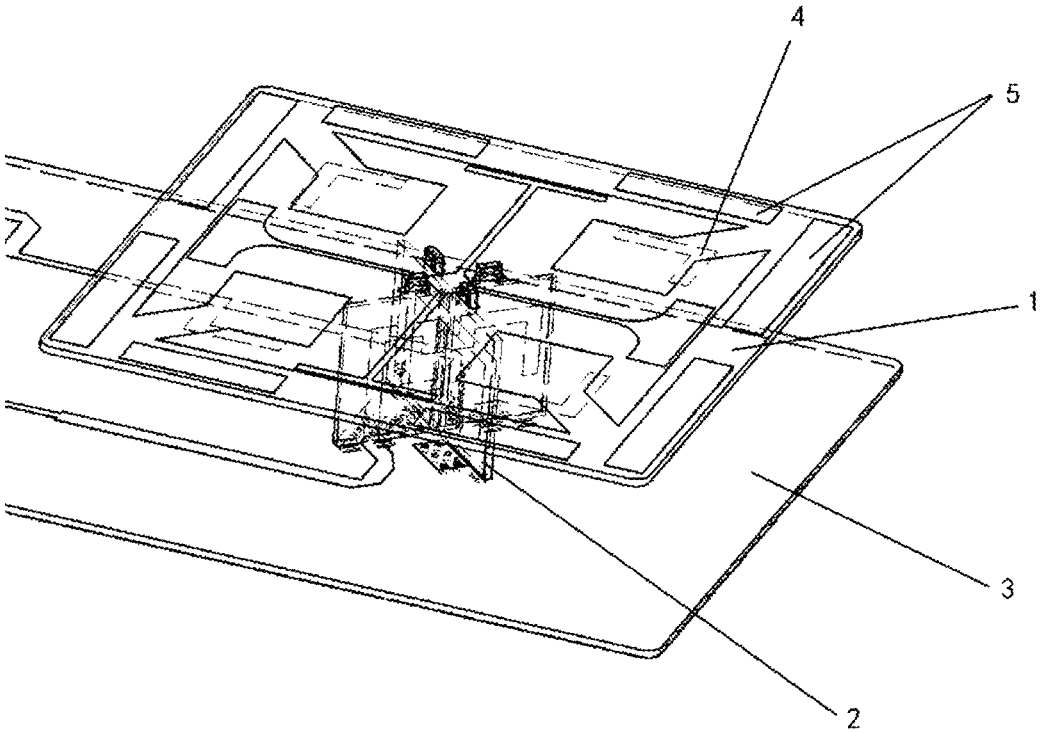
FIG. 1 is an elevation view of a broadband low-profile dual-linearly polarized antenna in accordance with disclosed embodiments.
Figure 2:
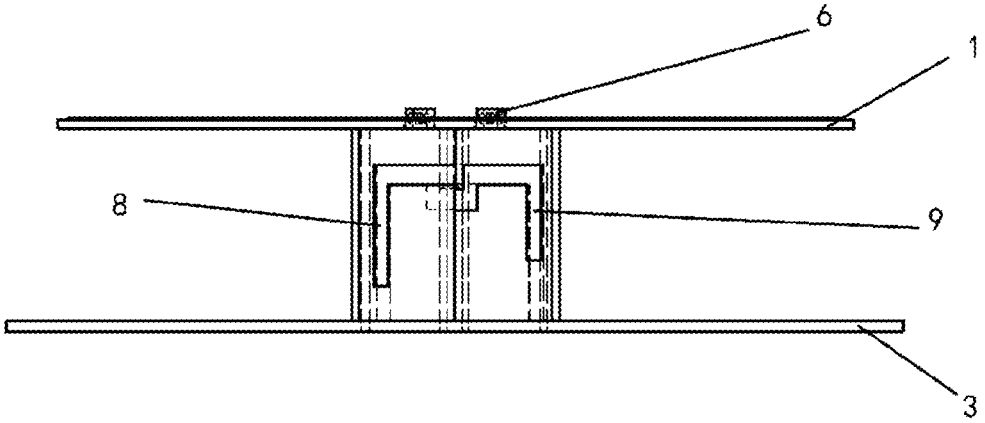
FIG. 2 is a side view of a broadband low-profile dual-linearly polarized antenna in accordance with disclosed embodiments.

In some embodiments, a broadband low-profile dual-linearly polarized antenna as shown in FIG. 1 and FIG. 2 can include a radiating portion 1 and a feed balun 2. The radiating portion 1 can have a rectangular plate shape, and the feed balun 2 can be located at a center below the radiating portion 1. As shown in FIG. 1 and FIG. 2, the feed balun 2 can be placed on a feed circuit board 3.

The feed balun 2 can include a first balun 8 and a second balun 9 that are orthogonal to each other and can be connected to a lower surface of the radiating portion 1 to feed the radiating portion 1. Two plates of the feed balun 2 can be snapped together through a middle slot, wherein an upper end of a middle part of one of the two plates can have a short slot, and a lower end of a middle part of another of the two plates can have a long slot, thereby implementing the feed balun 2 through a mating connection of the long slot and the short slot.

Figure 3:
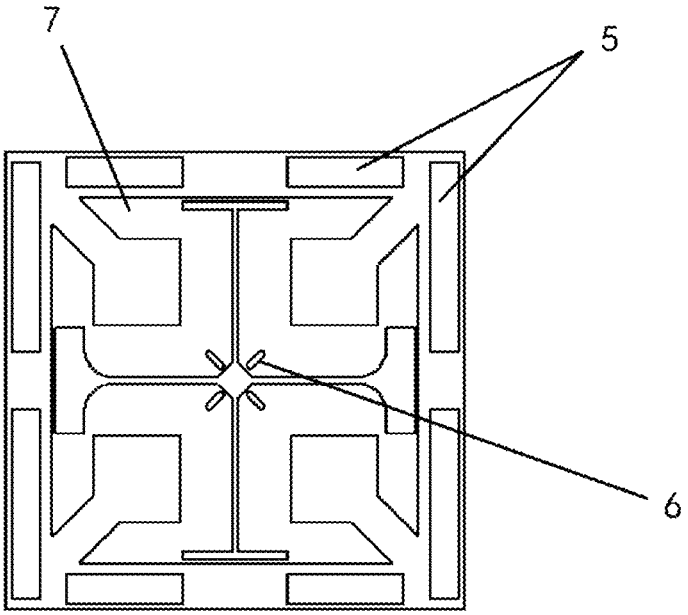
FIG. 3 is a top view of a radiating portion of a broadband low-profile dual-linearly polarized antenna in accordance with disclosed embodiments.
Figure 4:
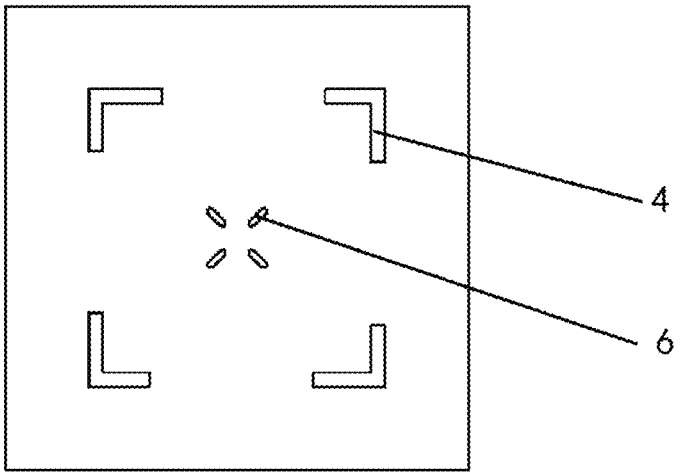
FIG. 4 is a bottom view of a radiating portion of a broadband low-profile dual-linearly polarized antenna in accordance with disclosed embodiments.

As shown in FIG. 3 and FIG. 4, the radiation portion 1 can include a dielectric substrate, printed folded dipoles 7 spaced apart on an upper surface of the dielectric substrate, first coupled parasitic elements 4 on a lower surface of the dielectric substrate, and second coupled parasitic elements 5 on the upper surface of the dielectric substrate. The radiating portion 1 can be implemented on a printed circuit board by a printing process.

The printed folded dipoles 7 may be placed at equal or unequal intervals on the dielectric substrate. As shown in FIG. 3, a number of the printed folding dipoles 7 can be four, and the printed folding dipoles 7 can be placed at equal intervals of 90 degrees. As further shown in FIG. 3, each of the printed folded dipoles 7 can have a respective T-shaped match and have a respective T-shaped slit inside to form a respective current path. In some embodiments, shapes of such T-shaped slits inside of the printed folded dipoles 7 need not be totally identical. For example, in some embodiments, a top of the T-shaped slits inside of upper and lower ones of the printed folding dipoles 7 can be narrower than a top of the T-shaped slits inside of left and right ones of the printed folding dipoles 7. Furthermore, in some embodiments, there can be a respective space between each of adjacent ones of the printed folded dipoles 7, and an inside of the respective space can be substantially square while an outside of the respective space can be a respective small opening. For the formation and principle of the printed folded dipoles 7 having a T-shaped match, reference may be made to the prior art, and details are not described herein again.

Each of the printed folded dipoles 7 can include a corresponding one of the first coupled parasitic elements 4 and a corresponding one of the second coupled parasitic elements 5 on either side, wherein the first coupled parasitic elements 4 are on the lower surface of the dielectric substrate, and the second coupled parasitic elements 5 are on the upper surface of the dielectric substrate. The first and second coupled parasitic elements 4, 5 can be used to expand bandwidth and reduce a profile of the broadband low-profile dual-linearly polarized antenna.

Each of the printed folded dipoles 7 can be non-electrically connected to the corresponding one of the first and second coupled parasitic elements 4, 5, but inductively induce current on the corresponding one of the first and second coupled parasitic elements 4, 5. Positions of the first and second coupled parasitic elements 4, 5 can be reasonably arranged according to requirements of inductive coupling. Accordingly, the specific shapes of the first and second coupled parasitic elements 4, 5 shown in FIG. 3 and FIG. 4 act only as an example, but not a limitation.

For example, as shown in FIG. 4, the first coupled parasitic elements 4 can be generally shaped as "⌈", "⌉", "⌊" and "⌋", and each of the first coupled parasitic elements 4 can be located between respective ones of the adjacent ones of the printed folded dipoles 7 with a respective notch facing inward. In some embodiments, each of the first coupled parasitic elements 4 can be located inside of respective outer contours the respective ones of the adjacent ones of the printed folded dipoles 7, and in some embodiments, each of the first coupled parasitic elements 4 can be located right below respective inner sides of the respective small opening between the respective ones of the adjacent ones of the printed folded dipoles 7.

In some embodiments, each of the second coupled parasitic elements 5 can include two respective rectangular strips that need not be electrically connected in substantially the shape of the Chinese character "八" and can be placed adjacent to respective neighboring portions of respective outer edges the respective ones of the adjacent ones of the printed folded dipoles 7. In some embodiments, such rectangular strips can be different sizes, and a long side can be parallel to the respective outer edges of one of the printed folded dipoles 7.

Each of the printed folded dipoles 7 can have a corresponding feed point 6 located therein, and the feed balun 2 can feed each of the printed folded dipoles 7 through the corresponding feed point 6 in a manner of coupled feed.

FIG. 5(*a*) is a side view of portions of the first and second baluns 8, 9 of the feed balun 2 (other portions of the baluns 8, 9 are obscured). As shown in FIG. 5(*a*), a middle of the second balun 9 can include a recess to bypass the first balun 8 to avoid electrical connection (or, alternatively, to form a protrusion). FIG. 5(*b*) and FIG. 5(*c*) show the portions of the first and second baluns 8, 9 that are obscured in FIG. 5(*a*). As shown in FIG. 5(*a*), FIG. 5(*b*), and FIG. 5(*c*), shapes of the first and second baluns 8, 9 need not be the same, but both can be substantially "ㄱㄱ" in shape and feed the radiating portion 1 at the top through a coupling manner.

The bottom of the feed balun 2 can be connected to a feed circuit. By way of example and not limitation, the feed circuit can be implemented using a microstrip circuit.

Figure 6:
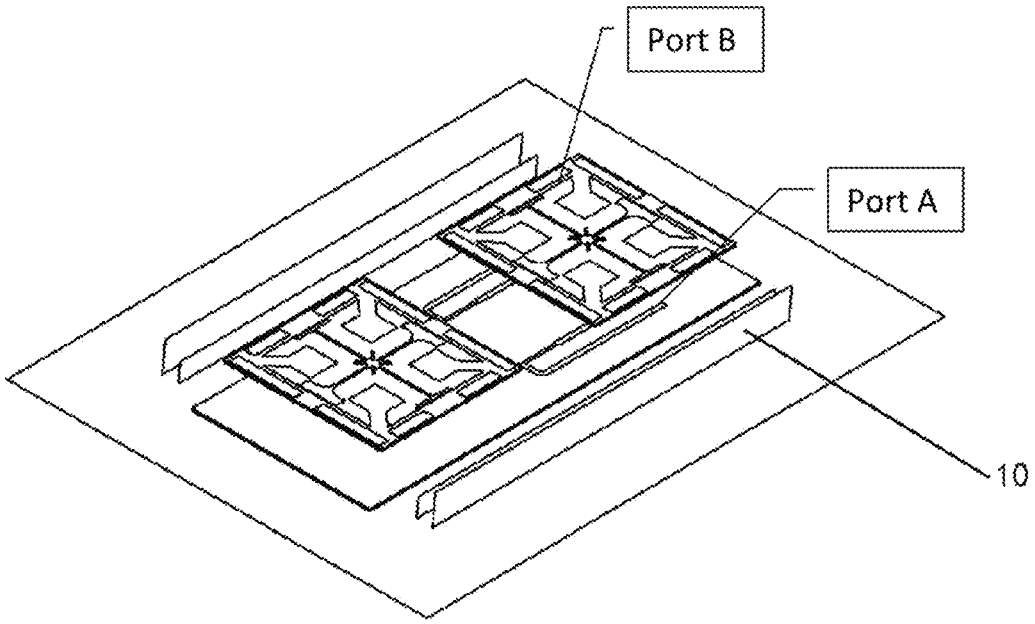
FIG. 6 is a view of a broadband low-profile antenna array device in accordance with disclosed embodiments that includes broadband low-profile dual-linearly polarized antennas as shown in FIG. 1 and FIG. 2.

FIG. 6 is a view of a broadband low-profile dual-linearly polarized antenna array device in accordance with disclosed embodiments. FIG. 6 only shows two dual-linearly polarized antennas, but embodiments disclosed herein are not so limited, and such an antenna array device can include any number of dual-linearly polarized antennas as appropriate. As shown in FIG. 6, a feed network can feed the antenna array device. The feed network can include a one-to-two power divider so as to feed each of the dual-linearly polarized antennas with equal amplitude and same phase. The feed network can have two feed ports (i.e., port A and port B shown in FIG. 6) for respectively exciting two polarization modes of ±45° to feed each of the dual-linearly polarized antennas through the one-to-two power divider.

The antenna array device may also include a bottom metal reflector, and the feed network may be located above the bottom metal reflector. The bottom metal reflector can be made of a metal plate, such as a copper plate, and can have a metal flange.

In some embodiments, the antenna array device may include a radome.

By performing a performance test on the antenna array device shown in FIG. 6, the following test results and conclusions can be obtained.

Figure 7A:
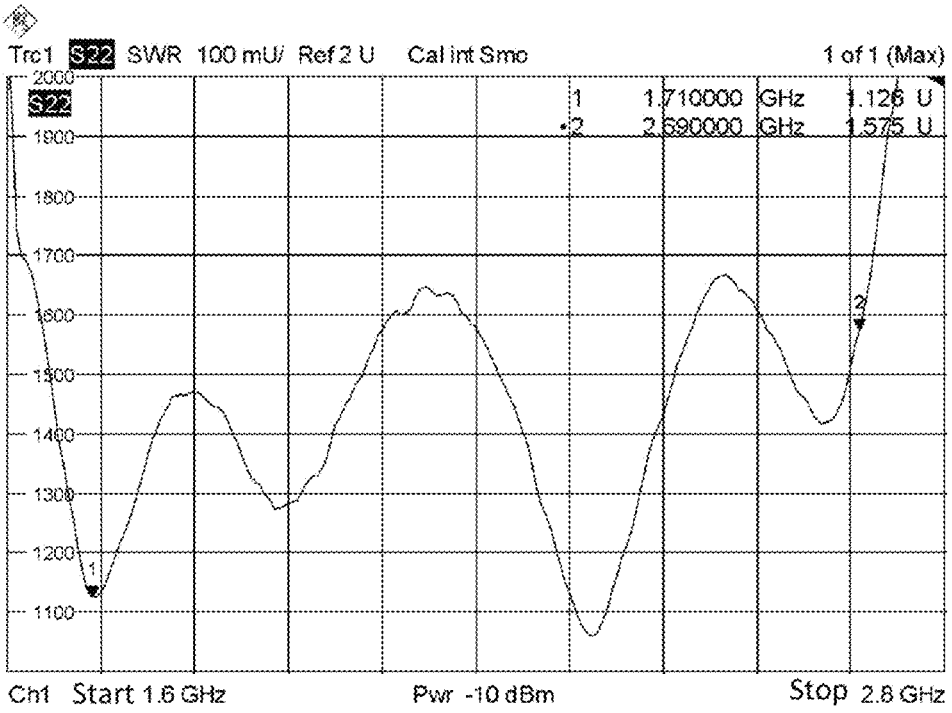
FIG. 7(*a*) is a graph of a standing wave ratio curve of port A of the broadband low-profile antenna array device shown in FIG. 6.
Figure 7B:
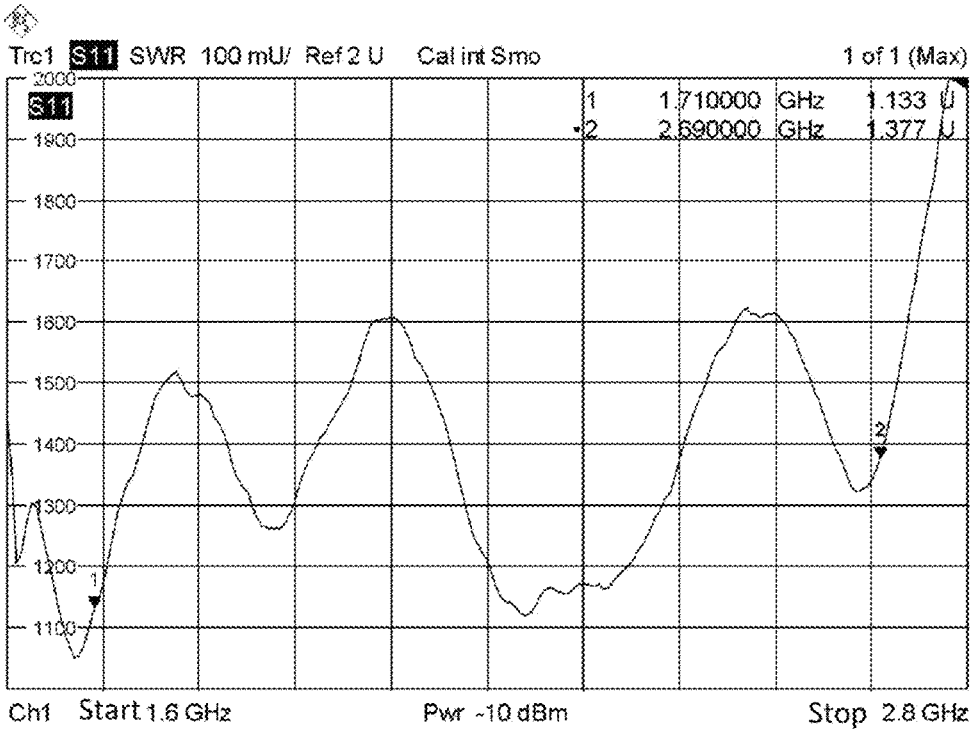

As shown in FIG. 7(*a*) and FIG. 7(*b*), when frequency is around 1.8 GHz and 2.6 GHz, standing wave ratios can be 1.7 or less, regardless of port A or port B.

Figure 8:
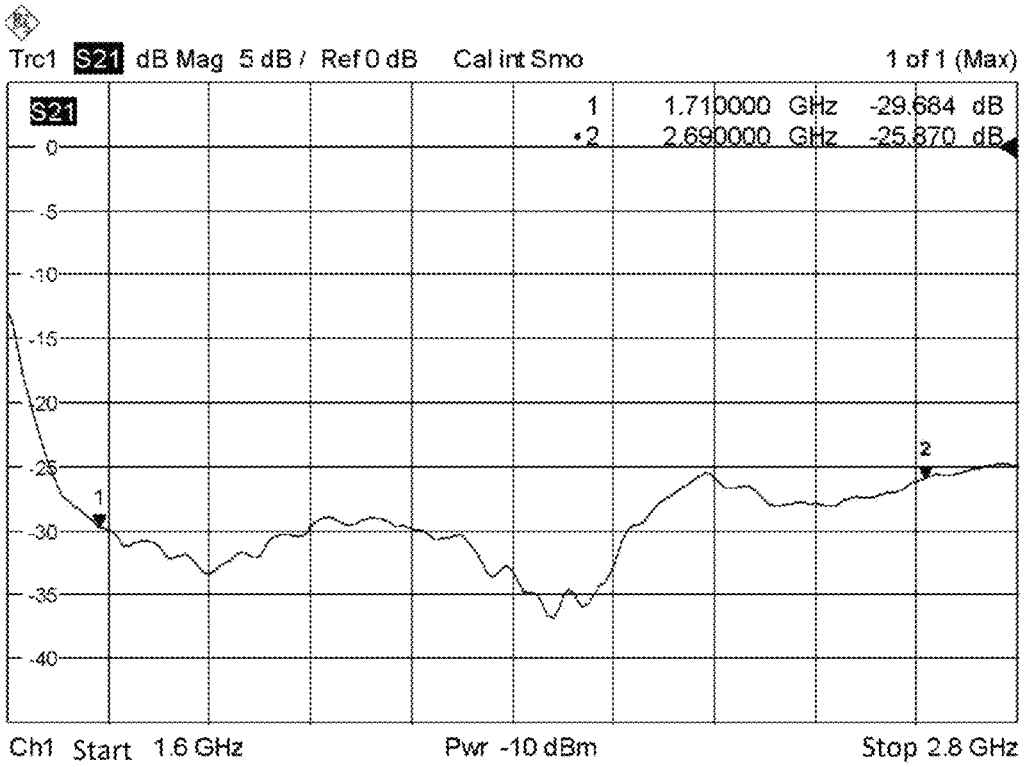
FIG. 8 is a graph of an isolation curve of port A and port B of the broadband low-profile antenna array device shown in FIG. 6.

As shown in FIG. 8, when the frequency is around 1.8 GHz and 2.6 GHz, isolation of port A and port B can be kept below −25 dB.

As shown in FIG. 9(*a*), FIG. 9(*b*), FIG. 9(*c*), FIG. 9(*d*), FIG. 10(*a*), FIG. 10(*b*), FIG. 10(*c*), and FIG. 10(*d*), for port A or port B, an influence of frequency variation on radiation directivity of the broadband low-profile dual-linearly polarized antenna is not obvious, and radiant energy is mainly concentrated in the horizontal front. As further shown in FIG. 9(*a*), FIG. 9(*b*), FIG. 9(*c*), FIG. 9(*d*), FIG. 10(*a*), FIG. 10(*b*), FIG. 10(*c*), and FIG. 10(*d*), when the frequency is around 1.8 GHz and 2.6 GHz, gains of port A and port B can both be maintained above 10 dBi, and efficiencies can both be maintained above 80%.

As shown in FIG. 11(*a*) and FIG. 11(*b*), for port A or port B, radiation is dominated by a main polarization, and a high cross-polarization ratio is achieved.

In summary, the broadband low-profile dual-linearly polarized antenna and the antenna array device disclosed herein can effectively realize a low-profile (reducing antenna thickness of about 35 mm in conventional cross-polarized antennas to 19 mm), can implement a wide frequency band of 1700 MHz to 2700 MHz, and can achieve high gain, high efficiency, high cross-polarization ratio, and high isolation. Furthermore, the broadband low-profile dual-linearly polarized antenna and the antenna array device disclosed herein have such advantages as simple structure, neat appearance, easy engineering implementation, and suitability for mass production.

Although this disclosure has described specific embodiments and generally associated methods, modifications and replacements of these embodiments and methods will be apparent to those skilled in the art. Therefore, the above description of exemplary embodiments does not limit or constrain this disclosure. Other variations, substitutions, and modifications are also possible without departing from the spirit and scope of the disclosure limited by the following claims.

What is claimed is:

1. A broadband low-profile dual-linearly polarized antenna comprising:

a radiating portion, wherein the radiating portion comprises a dielectric substrate, four printed folded dipoles spaced apart on an upper surface of the dielectric substrate, first coupled parasitic elements on a lower surface of the dielectric substrate, and second coupled parasitic elements on the upper surface of the dielectric substrate; and a feed balun for feeding the radiating portion, wherein each of the four printed folded dipoles includes a respective corresponding one of the first coupled parasitic elements and a respective corresponding one of the second coupled parasitic elements, wherein each of the first coupled parasitic elements is located between respective adjacent ones of the four printed folded dipoles, and wherein each of the second coupled parasitic elements is placed adjacent to respective neighboring portions of respective outer edges of the respective adjacent ones of the four printed folded dipoles.

2. The broadband low-profile dual-linearly polarized antenna according to claim 1, wherein each of the four printed folded dipoles has a respective T-shaped match.

3. The broadband low-profile dual-linearly polarized antenna according to claim 2, wherein the first coupled parasitic elements are generally shaped as Unicode hex character 250C, Unicode hex character 2510, Unicode hex character 2514, and Unicode hex character 2518, and wherein each of the first coupled parasitic elements includes a respective notch facing inward.

4. The broadband low-profile dual-linearly polarized antenna according to claim 3, wherein each of the first coupled parasitic elements is located inside of respective outer contours of the respective adjacent ones of the four printed folded dipoles.

5. The broadband low-profile dual-linearly polarized antenna according to claim 2, wherein each of the second coupled parasitic elements includes two respective rectangular strips that need not be electrically connected.

6. The broadband low-profile dual-linearly polarized antenna according to claim 1, wherein the feed balun comprises two orthogonal baluns, and wherein each of the two orthogonal baluns is substantially shaped as Unicode hex character 220F.

7. The broadband low-profile dual-linearly polarized antenna according to claim 1, wherein the feed balun feeds the radiating portion in a manner of coupled feed.

8. The broadband low-profile dual-linearly polarized antenna according to claim 1, wherein the four printed folded dipoles are placed at equal or unequal intervals.

9. The broadband low-profile dual-linearly polarized antenna according to claim 8, wherein the four printed folded dipoles are placed at the equal intervals of 90 degrees.

10. The broadband low-profiled dual-linearly polarized antenna according to claim 1, wherein the radiating portion is rectangular.

11. A broadband low-profile dual-linearly polarized antenna array device comprising:

a plurality of dual-linearly polarized antennas, wherein each of the plurality of dual-linearly polarized antennas includes the broadband low-profile dual-linearly polarized antenna of claim 1;

a feed network comprising a power divider for feeding the plurality of dual-linearly polarized antennas in equal amplitude and in same phase, wherein the feed network has two feed ports for respectively exciting two polarization modes of ±45° to feed each of the plurality of dual-linearly polarized antenna through the power divider; and a bottom metal reflector.

12. The broadband low-profile dual-linearly polarized antenna array device according to claim 11, wherein the plurality of dual-linearly polarized antennas has a number of two, and wherein the power divider is a one-to-two power divider.

13. The broadband low-profile dual-linearly polarization antenna array device according to claim 11, wherein the bottom metal reflector includes a metal flange.

* * * * *